US006005232A

United States Patent [19]

Janvrin et al.

[11] Patent Number: 6,005,232

[45] Date of Patent: Dec. 21, 1999

[54] HEATING CABLE

[75] Inventors: Aron K. Janvrin, Palo Alto; Glen W. Osterhout, Fremont, both of Calif.

[73] Assignee: Raychem Corporation, Menlo Park, Calif.

[21] Appl. No.: 08/672,603

[22] Filed: Jun. 28, 1996

[51] Int. Cl.[6] ..... B65D 1/24

[52] U.S. Cl. ..... 219/549; 219/528; 219/549

[58] Field of Search ..... 219/505, 528, 219/549, 544, 553; 392/472; 338/214, 212, 211, 332; 174/103, 108

[56] References Cited

U.S. PATENT DOCUMENTS

| | | | |
|---|---|---|---|
| 3,584,139 | 6/1971 | Swanson | 174/103 |
| 3,757,086 | 9/1973 | Indoe | 219/528 |
| 3,805,667 | 4/1974 | Orser | 87/6 |
| 3,858,144 | 12/1974 | Bedard et al. | 338/22 R |
| 3,861,029 | 1/1975 | Smith-Johannsen et al. | 29/611 |
| 4,017,715 | 4/1977 | Whitney et al. | 219/553 |
| 4,242,573 | 12/1980 | Batliwalla | 219/528 |
| 4,334,148 | 6/1982 | Kampe | 219/553 |
| 4,334,351 | 6/1982 | Sopory | 29/611 |
| 4,426,339 | 1/1984 | Kamath et al. | 264/22 |
| 4,459,473 | 7/1984 | Kamath | 219/553 |
| 4,523,086 | 6/1985 | Eilentropp | 219/549 |
| 4,574,188 | 3/1986 | Midgley et al. | 219/549 |
| 4,575,620 | 3/1986 | Ishii et al. | 219/549 |
| 5,111,032 | 5/1992 | Batliwalla et al. | 219/549 |
| 5,145,007 | 9/1992 | Dinkins | 166/386 |
| 5,146,982 | 9/1992 | Dinkins | 166/65.1 |
| 5,206,485 | 4/1993 | Srubas | 219/549 |
| 5,245,161 | 9/1993 | Okamoto | 219/549 |
| 5,558,794 | 9/1996 | Jansens | 219/549 |

FOREIGN PATENT DOCUMENTS

| | | | |
|---|---|---|---|
| 655 558 | 11/1964 | Belgium . | |
| 0 096 492 | 12/1983 | European Pat. Off. | H05B 3/14 |
| 0 235 454 | 9/1987 | European Pat. Off. | H01B 1/24 |
| 16 85 853 B2 | 10/1975 | Germany | D07B 1/06 |
| 91/12701 | 8/1991 | WIPO | H05B 3/34 |
| 91/17642 | 11/1991 | WIPO | H05B 3/00 |
| WO 91/17642 | 11/1991 | WIPO | 219/549 |

OTHER PUBLICATIONS

"XTV Chemelex Auto–Trace® Self–Regulating Heater" brochure, Raychem Corporation, Jun. 1986.

"HKTV2–FS Chemelex Auto Trace® Self–Regulating Heater for Division 1 Locations" brochure, Raychem Corporation, Jun. 1986.

International Search Report for Application No. PCT/US97/11057, dated Oct. 10, 1997.

*Primary Examiner*—Teresa Walberg
*Assistant Examiner*—Quang Van
*Attorney, Agent, or Firm*—Marguerite E. Gerstner; Herbert G. Burkard

[57] ABSTRACT

An electrical heating cable in which at least two elongate conductors are separated by an insulating spacer and are contacted by at least one elongate resistive heating strip. The heating strip, which contacts alternately the first conductor and the second conductor at contact points which are longitudinally spaced apart along the length of the strip and along the length of each of the conductors, is made from a conductive polymer composition which exhibits PTC behavior. The conductors are concentric stranded wires having a lay length L of at most 20 mm or a lay angle β of at least 11°, or a lay length L of at most 20 mm and a lay angle β of at least 10°.

20 Claims, 2 Drawing Sheets

HEATING CABLE

BACKGROUND OF THE INVENTION

1. Field of the Invention

This invention relates to heating cables, in particular self-regulating electrical heating cables.

2. Introduction to the Invention

Elongate electrical heating cables are well known for use in the freeze protection and temperature maintenance of pipes, tanks, and other substrates. Particularly useful elongate heating cables comprise (a) first and second elongate electrodes, (b) a plurality of resistive heating elements connected in parallel between said electrodes, and (c) an insulating jacket which surrounds the electrodes and heating elements. In addition, the heating cable often also comprises a metallic grounding layer, in the form of a braid or a tape, surrounding the insulating jacket, which serves to electrically ground the heating cable and provides mechanical protection. Because of the parallel construction of the heating elements, such heating cables may be cut to the appropriate length for use in each application.

For many applications it is preferred that the resistive heating elements comprise a conductive polymer, i.e. a polymer matrix in which is dispersed a particulate conductive filler. The conductive polymer preferably exhibits positive temperature coefficient (PTC) behavior, allowing the heating cable to be self-regulating. Two types of elongate heating cables are common. In the first, the conductive polymer is in the form of a continuous strip in which the electrodes are embedded. Such heaters are described, for example, in U.S. Pat. Nos. 3,858,144 (Bedard et al), 3,861,029 (Smith-Johannsen et al), 4,017,715 (Whitney et al), 4,242,573 (Batliwalla), 4,334,148 (Kampe), 4,334,351 (Sopory), 4,426,339 (Kamath et al), 4,574,188 (Midgley et al), and 5,111,032 (Batliwalla et al), and International Patent Publication No. WO91/17642 (Raychem Corporation, published Nov. 14, 1991). In the second type of heating cable, the conductive polymer is in the form of a continuous strip which is wrapped around the elongate electrodes, contacting the exposed electrodes alternately as it progresses down the length of the heating cable. In this configuration the electrodes are generally separated from one another by an insulating spacer. Alternatively, the electrodes can be wrapped around a core comprising the conductive polymer strip. Cables of this type are described in U.S. Pat. No. 4,459,473 (Kamath). The disclosure of each of these patents and publications is incorporated herein by reference.

Under normal operating conditions, an elongate heating cable is subject to physical stress and deformation as it is positioned in contact with the substrate to be heated. For example, when the substrate is a pipe or conduit, the cable is often wrapped around the pipe in a spiral manner. Furthermore, the cable must be wrapped around valves, joints, and other regions which must be heated. Although heating cables are flexible, certain conditions such as small pipe or valve diameters will require the cable to be bent or twisted. In addition, under normal use conditions, the heating cables undergo thermal cycling from relatively low temperatures to high temperatures. Both the physical stresses due to positioning on the substrate and the thermal stresses induced by the thermal cycling may cause changes in the heating cable. In particular, if the electrodes are positioned at opposite edges of a spacer, rather than embedded within a conductive polymer strip, the electrodes may move away from their position in the spacer, and/or may decrease contact with the conductive polymer strip wrapped around them.

SUMMARY OF THE INVENTION

We have now found that the selection of a particular type of wire for use as an electrode will produce a heating cable less subject to deformation. As a result, the heating cables of the invention have consistent and reliable performance even though subject to physical and thermal stresses. In a first aspect this invention provides an electrical heating cable which comprises (1) first and second elongate, spaced-apart, conductors which can be connected to a source of electrical power, each of said first and second conductors comprising a concentric stranded wire having a lay angle β of at least 11°;

(2) an elongate resistive heating strip which
  (a) comprises an elongate PTC component which (i) runs the length of the heating strip and (ii) is composed of a conductive polymer composition which exhibits PTC behavior, and
  (b) is in electrical contact alternately with the first conductor and the second conductor at contact points which are longitudinally spaced apart along the length of the strip and along the length of each of the conductors; and (3) a strip of insulating material which lies between the conductors so that, when the conductors are connected to a power source, all the current passing between the conductors passes through the heating strip.

In a second aspect, the invention provides an electrical heating cable which comprises (1) first and second elongate, spaced-apart, conductors which can be connected to a source of electrical power, each of said first and second conductors comprising a concentric stranded wire having a lay length L of at most 20 mm (0.8 inch);

(2) an elongate resistive heating strip which
  (a) comprises an elongate PTC component which (i) runs the length of the heating strip and (ii) is composed of a conductive polymer composition which exhibits PTC behavior, and
  (b) is in electrical contact alternately with the first conductor and the second conductor at contact points which are longitudinally spaced apart along the length of the strip and along the length of each of the conductors; and (3) a strip of insulating material which lies between the conductors so that, when the conductors are connected to a power source, all the current passing between the conductors passes through the heating strip.

In a third aspect, the invention provides an electrical heating cable which comprises (1) first and second elongate, spaced-apart, conductors which can be connected to a source of electrical power, each of said first and second conductors comprising a concentric stranded wire having a lay length L of at most 20 mm (0.8 inch) and a lay angle β of at least 10°;

(2) an elongate resistive heating strip which
  (a) comprises an elongate PTC component which (i) runs the length of the heating strip and (ii) is composed of a conductive polymer composition which exhibits PTC behavior, and
  (b) is in electrical contact alternately with the first conductor and the second conductor at contact points which are longitudinally spaced apart along the length of the strip and along the length of each of the conductors; and (3) a strip of insulating material which lies between the conductors so that, when the conductors are connected to a power source, all the current passing between the conductors passes through the heating strip.

BRIEF DESCRIPTION OF THE DRAWINGS

The invention is illustrated by the drawings in which.

DETAILED DESCRIPTION OF THE INVENTION

Figure 1:
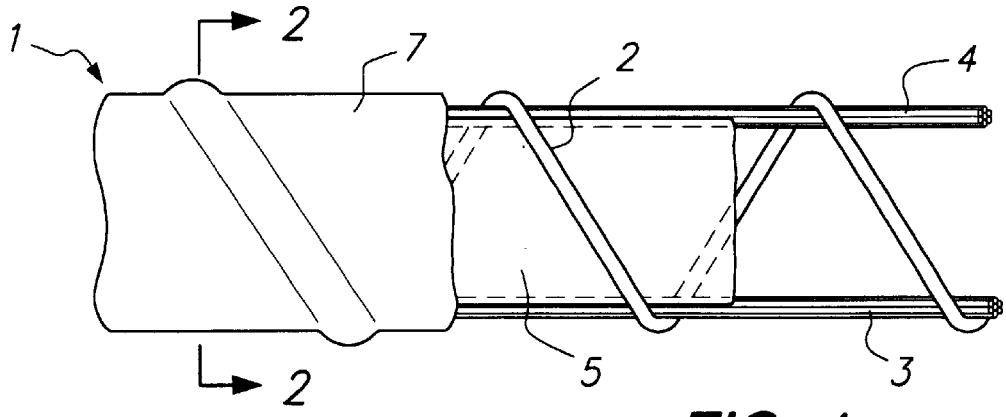
FIG. 1 is a plan view of a heating cable of the invention.

The heating cable of the invention comprises at least one elongate heating strip which comprises an elongate PTC component which runs the length of the heating strip and is composed of a conductive polymer composition which exhibits PTC behavior. In this specification the term "PTC" is used to mean a sharp increase in resistivity with temperature over a relatively small temperature range, i.e. the composition has an $R_{14}$ value of at least 2.5 and/or an $R_{100}$ value of at least 10, and it is preferred that the composition should have an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. The composition comprises a polymeric component which is preferably a crystalline polymer, i.e. a polymer which has a crystallinity before being processed into the composition of at least 20%. Suitable crystalline polymers include polyolefins, e.g. polyethylene or ethylene copolymers; fluoropolymers, e.g. polyvinylidene fluoride (PVDF), ethylene/tetrafluoroethylene copolymer (ETFE), or tetrafluoroethylene/ perfluoroalkoxy copolymer (PFA); or mixtures of two or more such polymers. Alternatively, the polymeric component may comprise an elastomer, e.g. a thermoplastic elastomer. Dispersed in the polymeric component is a particulate conductive filler, e.g. carbon black, graphite, metal, metal oxide, conductive coated glass or ceramic beads, particulate conductive polymer, or a combination of these. Additional components such as antioxidants, inert fillers, nonconductive fillers, radiation crosslinking agents (often referred to as prorads or crosslinking enhancers), stabilizers, dispersing agents, coupling agents, acid scavengers (e.g. $CaCO_3$), or other components may also be present. Examples of suitable compositions are given in the documents listed above.

The resistivity of the conductive polymer composition at 23° C. is usually 1 to 100,000 ohm-cm, preferably 100 to 10,000 ohm-cm, particularly, 1,000 to 10,000 ohm-cm, especially 1,000 to 5,000 ohm-cm. For most applications, the resistivity at 23° C. is at least 100 ohm-cm.

The heating strip can be made by any convenient technique, e.g. by melt-extrusion which is generally preferred, or by passing a substrate through a liquid, e.g. solvent-based, composition, followed by cooling and/or solvent removal. When producing the strip by melt-extrusion, the draw-down ratio has an important effect on the electrical properties of the heating cable. For example, the use of higher draw-down ratio may increase the resistance uniformity of the strip, but decreases the extent of the PTC effect. The optimum draw-down ratio depends on the particular conductive polymer composition.

The heating strip may have any convenient shape, e.g. round or elliptical cross-section, or be in the form of a flat tape. The thickness of the heating strip is generally 0.25 to 2.5 mm (0.010 to 0.1 inch), preferably 0.38 to 2.16 mm (0.015 to 0.085 inch), particularly 0.51 to 1.91 mm (0.020 to 0.075 inch).

Figure 4:
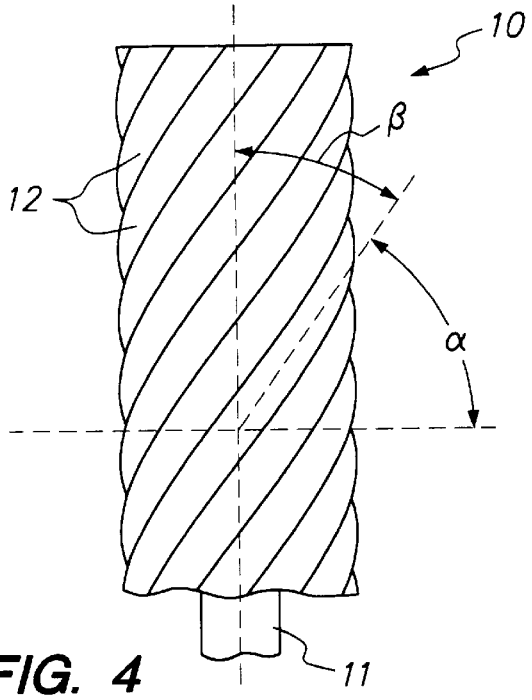
FIG. 4 is a schematic diagram of a conductor to be used in a heating cable of the invention.

The heating cable of the invention comprises first and second elongate conductors which can be connected to a source of electrical power, e.g. a power supply or a wall outlet, using an appropriate plug or electrical component if necessary. The conductors (also referred to in this specification as electrodes or wires) are preferably of metal, e.g. nickel, copper, tin, aluminum, nickel-coated copper, tin-coated copper, metal alloys, or other suitable material. The conductors have a concentric stranded configuration, i.e. a central (core) wire is surrounded by one or more layers of helically laid wires (strands) laid in a reverse direction so that successive layers are laid with opposite direction of lay. Each successive layer of wire strands in a concentric configuration has a greater lay length than the layer below. The lay length L is the axial distance required for an individual wire strand to be wrapped 360° around the central (core) wire. In this application, the specified lay length is that of the outermost layer of helically laid wires. This configuration is in contrast to (1) a unilay configuration in which a central wire is surrounded by more than one layer of helically laid wires, each layer of which has the same direction of lay and the same lay length; and (2) a unidirectional concentric configuration in which a central wire is surrounded by one or more layers of helically laid wires which have the same direction of lay, but an increasing lay length in each layer. Although the size of the conductors used in heating cables of the invention is dependent on the applied voltage, the desired current-carrying capability, and required cable length, most cables of the invention have a size of at most 14 AWG, i.e. 1.93 mm (0.076 inch) diameter, although smaller diameter wires, e.g. 16 AWG (1.52 mm (0.060 inch)), 18 AWG (1.27 mm (0.050 inch)), or 20 AWG (1.02 mm (0.040 inch)), or larger diameter wires, e.g. 12 AWG (2.16 mm (0.085 inch) or 10 AWG (3.05 mm (0.12 inch), may be suitable for some applications. (AWG is American Wire Gauge, which is the same as Brown & Sharpe wire gauge.) The conductors used in heating cables of the invention have a lay length L of at most 20 mm (0.8 inch), preferably at most 18 mm (0.7 inch), particularly at most 15 mm (0.6 inch). Generally the lay length L is at least 14 mm (0.55 inch). The conductors used in heating cables of the invention have a lay angle $\beta$ of at least 10°, preferably at least 11°, particularly at least 12°, especially at least 13°. The lay angle $\beta$, as shown in FIG. 4, below, is a function of the helix angle $\alpha$ (i.e. the angle of wrap of the wire strand around the central wire). $\beta$ equals, i.e., and so is affected by the diameter of the central wire and the diameter of strand wrapped around the central wire. Generally $\beta$ is at most 16°. In a preferred embodiment, the conductors used in heating cables of the invention have a lay length L of at most 20 mm (0.8 inch) and a lay angle $\beta$ of at least 10°, preferably L of at most 18 mm (0.7 inch) and $\beta$ of at least 11°. Wires preferred for use as conductors in heating cables of the invention have a lay length L which can be defined in terms of the diameter of the core wire, $d_c$. Thus, for a conductor with seven strands, L is preferably less than $36d_c$, particularly less than $31d_c$, especially less than $28d_c$, for a conductor with nineteen strands, L is preferably less than $72d_c$, particularly less than $65d_c$, especially less than $55d_c$; and for a conductor with 37 strands, L is preferably less than $110d_c$, particularly less than $97d_c$, especially less than $80d_c$.

Although the heating cables of the invention generally contain two elongate conductors, for some applications there can be three or more conductors which are sequentially contacted by the heating strip, provided that the conductors are suitably connected to one or more suitable power sources. When three or more conductors are present, they can be arranged so that different power outputs can be obtained by connecting different pairs of conductors to a single phase or two phase power source. When three conductors are present they can be arranged so that the heating cable is suitable for connection to a three phase power source.

For some applications, the conductors can be coated with a layer of conductive material, e.g. a low resistivity ZTC (zero temperature coefficient of resistivity) conductive polymer composition, a graphite-, silver-, or carbon black-filled emulsion, or carbon black powder. The coating can be put on either before or after the conductors are contacted by the heating strip(s).

In order to ensure that the heating cable maintains its shape, the first and second conductors are separated from one another by means of a strip of insulating material which lies between the conductors so that when the conductors are connected to a power source, all the current passing between the conductors passes through the heating strip. The insulating strip (or spacer) is generally composed of an electrically insulating material, e.g. a polymer, ceramic, or glass, which will substantially maintain its shape during preparation and use of the heating cable, despite thermal expansion and contraction during normal use. For some applications, the insulating strip may comprise an element to improve the thermal conductivity of the spacer, e.g. a metal strip surrounded by the insulating strip or a thermally conductive particulate filler. The insulating strip will usually have the same general configuration as the conductors, e.g. if they are straight, the insulating strip is straight, and if they are wrapped, the insulating strip is wrapped with them. To improve the physical stability of the heating cable it is preferred that the insulating strip be configured so that the conductors can be held in close proximity to the spacer, e.g. by having concave or grooved sides or edges sized to accept the conductors.

Although at least one heating strip is present in heating cables of the invention and contacts the conductors, two or more heating strips may be present. If multiple heating strips are present, they are usually, but not necessarily parallel to one another along the length of the heating cable. They are preferably the same material but can be different in material and/or dimensions. For a particular heating strip, heating cables of the same power output can be obtained by a single strip wrapped at a relatively low pitch (a high number of turns per unit length) or by a plurality of parallel heating strips wrapped at a relatively high pitch. Use of a plurality of strips results in a lower voltage stress on the heating strip.

The conductors and the heating strip(s) can be positioned in a variety of configurations in order to produce the desired electrical contact at spaced-apart points. Generally it is preferred that the conductors be straight and the heating strip(s) follow a regular sinuous path, or vice-versa. The path may be, for example, generally helical (including generally circular and flattened circular helical), sinusoidal, or Z-shaped. However, it is also possible for both the conductors and the heating strip(s) to follow regular sinuous paths which are different in shape or pitch or of opposite hand, or for one or both to follow an irregular sinuous path. In one preferred configuration, the heating strip is wrapped around a pair of straight parallel conductors, which may be maintained the desired distance apart by means of a separator strip. In another configuration, the heating strip is wrapped around a separator strip and the wrapped strip is then contacted by straight conductors. In another preferred configuration, the conductors are wrapped around one or more straight heating strips and one or more straight insulating cores. In another configuration, the conductors are wrapped around an insulating core and are then contacted by straight heating strips. It is generally convenient for the wrapped element to have a generally helical configuration, such as may be obtained using conventional wire wrapping apparatus. For the best heat transfer to a substrate, it is often preferred that the heater has a shape which is generally rectangular with rounded corners.

Once the heating strips and the conductors are wrapped, a ZTC conductive polymer composition may be placed over the junctions between the conductors and the heating strip(s) to form a fillet and improve the electrical contact between the conductors and the strip(s).

The heating strip(s) may be crosslinked, e.g. by irradiation, either before or after they are assembled into the heating cable.

Additional heating cable configurations and preparation techniques are described in U.S. Pat. No. 4,459,473 (Kamath), the disclosure of which is incorporated herein by reference.

Figure 2:
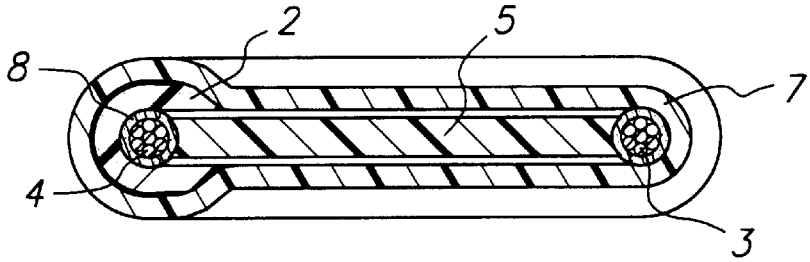
FIG. 2 is a cross-section along line 2—2 of FIG. 1.

The invention is illustrated by the drawings in which FIG. 1 is a plan view of heating cable 1 of the invention, and FIG. 2 is a cross-section of cable 1 along line 2—2. A single heating strip 2 is wrapped helically around first conductor 3 and second conductor 4 which are separated by insulating strip (spacer) 5. Electrical contact between heating strip 2 and conductors 3,4 is enhanced by means of low resistivity material 8 which forms a fillet between the strip and the conductor at the contact (junction) points. Polymeric insulating jacket 7 surrounds heating strip 2, conductors 3,4, and insulating strip 5.

Figure 3:
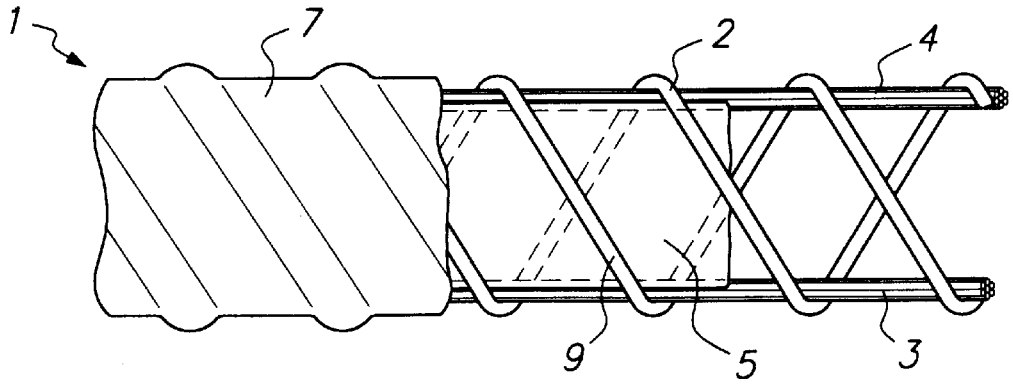
FIG. 3 is a plan view of another heating cable of the invention.

FIG. 3 is a plan view of another heating cable of the invention in which two heating strips 2,9 are wrapped around conductors 3,4, and insulating strip 5.

FIG. 4 shows in schematic fashion conductor 10 which is a concentrically stranded wire. Helix angle $\alpha$ and lay angle $\beta$ are shown.

Figure 5:
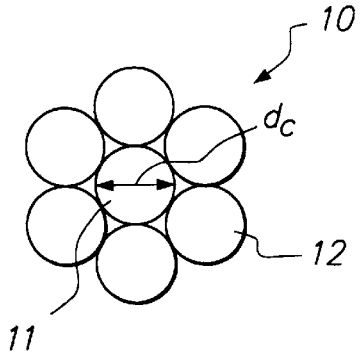
FIG. 5 is a cross-section of a conductor to be used in a heating cable of the invention.

FIG. 5 shows in cross-section seven-strand conductor 10, with core wire 11 and helical wires 12. Also shown is the core diameter $d_c$.

Figure 6:
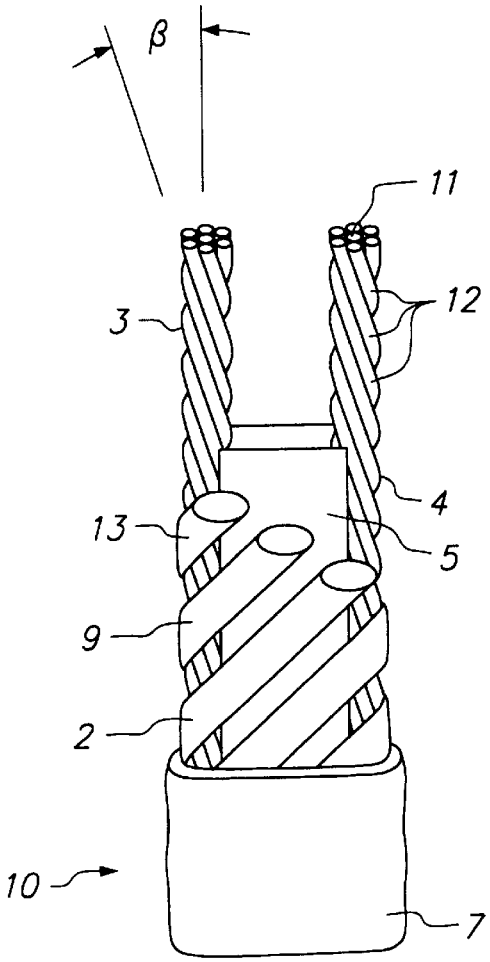
FIG. 6 shows a plan view of a heating cable of the invention.

FIG. 6 shows a plan view of a heating cable of the invention in which three heating strips 2,9,13 are wrapped around conductors 3,4 and insulating strip 5. They lay angle B for this heating cable is 15°.

The invention is illustrated by the following examples in which Example 2 is an example of the invention and Examples 1 and 3 to 6 are comparative examples. Each of the heating cables of the Examples was prepared according to a three-step procedure, which followed generally the procedure described in Example 2 of U.S. Pat. No. 4,459,473,the disclosure of which is incorporated herein by reference.

PREPARATION OF THE HEATING STRIP

A dry-blended mixture of tetrafluoroethylene/ perfluoroalkoxy copolymer (PFA) and carbon black was mixed in a twin screw extruder. The mixture was pelletized, dried, and extruded through a 1.52 mm (0.060 inch)-round die fitted to an extruder. The extrudate was drawn to give a heating strip with a diameter of 0.94 mm (0.037 inch).

PREPARATION OT THE SPACER

Glass-fiber filled PFA was dried and extruded through a concave-sided, flat-topped die to give an insulating spacer with concave sides and dimensions of 1.9×3.0 mm (0.075×0.120 inch).

ASSEMBLY OF HEATING CABLE

Two wires were positioned within the concave sides of the spacer and four individual heating strips were wrapped around the conductors and spacer strip in a spiral manner using a wrapping machine. The spacing between each adjacent heating strip was 4.3 mm (0.170 inch). The conductors, as well as the heating strip in the regions in which the conductors in contact with the heating strip, were coated with a graphite emulsion. The resulting heating cable was jacketed first with a layer of PFA, then with a tin-coated copper braid, and finally with a second layer of PFA. The jacketed heating cable was heat-treated and allowed to cool.

Examples 1 to 7

The 14 AWG wires shown in Table I were used as conductors in heaters made according to the above procedure. Each of the wires was nickel-coated copper (i.e. 2% nickel-plated electroplated (NPETP)), available from Hudson International Conductors.

TABLE I

| Ex. | Wire Type | # Strands | Strand Gauge (AWG) | Wire Diameter (mm/inch) | Strand Diameter (mm/inch) | Lay Length L (mm/inch) | Lay Angle β (degrees) |
|---|---|---|---|---|---|---|---|
| 1 | Concentric | 7 | 22 | 1.93/0.076 | 0.64/0.025 | 22.2/0.875 | 10.3 |
| *2 | Concentric | 7 | 22 | 1.93/0.076 | 0.64/0.025 | 14.5/0.571 | 15.5 |
| 3 | Concentric | 19 | 27 | 1.80/0.071 | 0.36/0.014 | 25.4/1.000 | 10.1 |
| 4 | Unilay | 19 | 27 | 1.80/0.071 | 0.36/0.014 | 20.3/0.800 | 12.6 |
| 5 | Unilay | 19 | 27 | 1.80/0.071 | 0.36/0.014 | 15.2/0.600 | 16.6 |
| 6 | Unilay | 37 | 30 | 1.78/0.070 | 0.25/0.010 | 19.1/0.750 | 14.1 |

*Example of the invention.

The heating cables of Examples 1 to 6 were tested according to Tests A to E, below. For each test, the results for each of the heating cables were ranked from best performance to worst performance. These results are shown in Table II. Example 4 heating cables had poorer performance than Example 5 heating cables for each test. Example 2 heating cables, which were an example of the invention, had the best overall performance.

TABLE II

| Performance | Test A | Test B | Test C | Test D | Test E |
|---|---|---|---|---|---|
| Best | 2 | 2 | 2,1 | 2 | 6 |
| | 6 | 6 | (Tie) | 1 | 2 |
| | 3 | 3 | 5 | 6 | 3 |
| | 5 | 5 | 3 | 3 | 5 |
| Worst | 1 | 1 | 6 | 5 | 1 |

Test A: Bend

This test measured the ability of a heating cable to withstand a bend in which one wire is placed in tension and the other wire is placed in compression. Such a bend can cause the compressed wire to buckle. This type of deformation can occur during installation when the heating cable is placed flat against a substrate but is forced around an object, e.g. a flange or bolt.

A heating cable with a length of 0.91 m (3 ft) was positioned flat on a substrate (the bottom platten) and two mandrels, each having a diameter of 6.4 mm (0.25 inch), were placed halfway down the cable, one on either side of the cable at the cable edge. The distance between the two conductors was measured. The top platten of the press was then placed on top of the cable and the mandrels to securely hold the mandrels, but leaving the cable free to slide back and forth but not turn over. Both ends of the cable were bent around one mandrel (i.e. each end bending 90° from the starting position) to a first position, then around the second mandrel (i.e. each end bending 180° from the first position), and then back to the starting position. In the first position, one of the conductors was in tension and one in compression, while in the second position, the conductor originally in tension was in compression and the conductor originally in compression was in tension. Any deformation of the conductor was noted and the distance between the conductors, measured at the closest point, was recorded. The test was repeated using mandrels with diameters of 25 mm (1 inch) and 51 mm (2 inches). The best performance was for cables having a distance between conductors closest to the starting distance.

Test B: Compression

This test measured the ability of a heating cable to withstand axial compression. Such compression can occur when the heating cable is attached to a stiff substrate, e.g. a tubing bundle, which is then bent so that the heating cable is on the inner radius.

One end of a sample of heating cable with a length of 133 mm (5.25 inch) was positioned in a first (upper) piece of a test fixture and the other end was positioned in a second (lower) piece of the fixture, leaving the center region of the cable free of the fixture. The distance between the conductors was measured. The fixture was inserted into an Instron™ apparatus and pressure was applied to the test fixture to compress the cable 4.6 mm (0.18 inch) at a rate of 2.5 mm/min (0.1 inch/min). The pressure was released, the cable removed from the test fixture, and the shortest distance between the conductors was measured. The best performance was for cables having a distance between conductors closest to the starting distance.

Test C: Temperature Cycling

This test measured the ability of a heating cable to withstand repeated heating and cooling which may generate thermal relaxation stresses in the cable. Such thermal cycling occurs during normal use of the heating cable, although this test exposed cable to more severe temperatures than commonly encountered.

The conductors in a heating cable with a length of 0.76 m (2.5 ft) were deliberately distorted by bending the cable 90° in each direction as in Test A. Sufficient bending was supplied until the distance between the conductors was 0.51 to 1.0 mm (0.02 to 0.04 inch). After recording this initial distance the cable was placed in a thermal chamber and cycled between −71° C. and 204° C. (−95° F. to 400° F.) ten times, with a dwell time of 30 minutes at −71° C. and 204° C. on each cycle. The distance between the conductors was then measured. The best performance was for cables in which the difference between the initial and final distances was the smallest.

Test D: Installation

This test measured the ability of a heating cable to withstand externally applied stresses and forces which cause deformation during installation.

A 3 m (10 ft) length of heating cable was installed on a 76 mm (3 inch) valve by wrapping it around the valve. The cable was then removed and reinstalled on the valve, this time forcing bends to occur in the cable in an opposite direction from those formed during the first installation. The cable was removed from the valve and inspected to determine the total number of deformed wires and the smallest distance between the conductors. The best performance was for cables in which there were few deformed wires and the largest distance between the conductors.

Test E: Cyclic Bend

This test measured the ability of a heating cable to withstand a repeated, small amplitude bend in which one wire is in tension while the other wire is in compression. Such bending can occur due to repeated flexing during maintenance of the cable and substrate, e.g. pipe.

A 0.3 m (1 ft) heating cable was positioned between two mandrels, each having a diameter of 12.7 mm (0.50 inch) and placed halfway down the cable at either edge of the cable (in a similar position to that described in Test A). The ends of the cable were clamped into a test fixture and an ohmmeter was attached to the conductors to measure the resistance of the cable. The sample was forced around the first mandrel (forward bend) to put one wire in tension and the second wire in compression and then around the second mandrel (reverse bend) to put the first wire in compression and the second wire in tension through a total angle of 120° at a rate of one complete cycle each 11 seconds. The test was continued until the earlier of 40 cycles or an indication (based on the resistance) that the conductors had been forced into contact with one another. The best performance was for cables which withstood the most cycles.

What is claimed is:

1. An electrical heating cable which comprises (1) first and second elongate, spaced-apart, conductors which can be connected to a source of electrical power, each of said first and second conductors comprising concentric standed wires having a lay angle β of at least 11°;

(2) an elongate resistive heating strip which (a) comprises an elongate PTC component which (i) runs the length of the heating strip and (ii) is composed of a conductive polymer composition which exhibits PTC behavior, and (b) is in electrical contact alternately with the first conductor and the second conductor at contact points which are longitudinally spaced apart along the length of the strip and along the length of each of the conductors; and (3) a strip of insulating material which lies between the conductors so that, when the conductors are connected to a power source, all the current passing between the conductors passes through the heating strip.

2. A cable according to claim 1 wherein β is at least 12°.

3. A cable according to claim 2 wherein β is at least 13°.

4. A cable according to claim 1 wherein β is at most 16°.

5. A cable according to claim 1 wherein the heating strip comprises a melt-extruded conductive polymer composition.

6. A cable according to claim 1 which comprises a plurality of heating strips which are wrapped around the conductors.

7. A cable according to claim 1 wherein the insulating strip comprises concave-shaped edges sized to accept the first and second conductors.

8. An electrical heating cable which comprises (1) first and second elongate, spaced-apart, conductors which can be connected to a source of electrical power, each of said first and second conductors comprising a concentric stranded wires having a lay length L of at most 20 mm (0.8 inch);

(2) an elongate resistive heating strip which (a) comprises an elongate PTC component which (i) runs the length of the heating strip and (ii) is composed of a conductive polymer composition which exhibits PTC behavior, and (b) is in electrical contact alternately with the first conductor and the second conductor at contact points which are longitudinally spaced apart along the length of the strip and along the length of each of the conductors; and (3) a strip of insulating material which lies between the conductors so that, when the conductors are connected to a power source, all the current passing between the conductors passes through the heating strip.

9. A cable according to claim 8 wherein L is at most 18 mm (0.7 inch).

10. A cable according to claim 9 wherein L is at most 15 mm (0.6 inch).

11. A cable according to claim 8 wherein L is at least 14 mm (0.55 inch).

12. An electrical heating cable which comprises (1) first and second elongate, spaced-apart, conductors which can be connected to a source of electrical power, each of said first and second conductors comprising a concentric stranded wires having a lay length L of at most 20 mm (0.8 inch) and a lay angle β of at least 10°;

(2) an elongate resistive heating strip which (a) comprises an elongate PTC component which (i) runs the length of the heating strip and (ii) is composed of a conductive polymer composition which exhibits PTC behavior, and (b) is in electrical contact alternately with the first conductor and the second conductor at contact points which are longitudinally spaced apart along the length of the strip and along the length of each of the conductors; and (3) a strip of insulating material which lies between the conductors so that, when the conductors are connected to a power source, all the current passing between the conductors passes through the heating strip.

13. A cable according to claim 12 wherein β is at least 11°.

14. A cable according to claim 12 wherein L is at most 18 mm (0.7 inch).

15. A cable according to claim 12 wherein the heating strip comprises a melt-extruded conductive polymer composition.

16. A cable according to claim 15 wherein the conductive polymer composition has a resistivity at 23° C. of at least 100 ohm-cm.

17. A cable according to claim 12 which comprises a plurality of heating strips which are wrapped around the conductors.

18. A cable according to claim 12 wherein the insulating strip comprises concave-shaped edges sized to accept the first and second conductors.

19. A cable according to claim 12 wherein there is a coating of a ZTC conductive polymer composition over junctions between the conductors and the heating strip.

20. A cable according to claim 12 wherein the first and second conductors comprise 14 AWG wires.

* * * * *